United States Patent [19]

Tanner et al.

[11] Patent Number: 4,896,706

[45] Date of Patent: Jan. 30, 1990

[54] BAG FOR TRANSPORTING DRY GRANULAR POWDERS

[75] Inventors: William J. Tanner, Glenhaven; Pawell Baltyn, Ermington, both of Australia

[73] Assignee: Amatek Limited, Australia

[21] Appl. No.: 263,785

[22] Filed: Oct. 27, 1988

[30] Foreign Application Priority Data

Nov. 3, 1987 [AU] Australia ..... PI5217
Jun. 20, 1988 [AU] Australia ..... PI8866

[51] Int. Cl.[4] ..... B65D 1/32

[52] U.S. Cl. ..... 141/114; 141/7; 141/10; 141/59; 141/65; 141/66; 141/231; 383/116

[58] Field of Search ..... 141/1, 4, 5, 7, 10, 141/59, 63, 65, 66, 67, 314, 93, 114, 231; 383/101, 103, 110, 111, 109, 114, 116; 220/401

[56] References Cited

U.S. PATENT DOCUMENTS

| | | | |
|---|---|---|---|
| 3,258,041 | 6/1966 | Lau | 141/10 |
| 3,261,379 | 7/1966 | Stockel et al. | 141/10 X |
| 3,865,280 | 2/1975 | Thomson | 141/10 X |
| 3,964,636 | 6/1976 | Rehrig | 220/401 X |
| 4,054,161 | 10/1978 | Alack | 141/93 X |
| 4,182,386 | 1/1980 | Alack | 141/83 |
| 4,312,388 | 1/1982 | Hager et al. | 141/1 |
| 4,730,647 | 3/1988 | Mulder | 141/67 |
| 4,795,057 | 1/1989 | Jungels et al. | 220/401 |

FOREIGN PATENT DOCUMENTS

| | | |
|---|---|---|
| 1241883 | 9/1983 | Australia . |
| WO82/03826 | 11/1982 | PCT Int'l Appl. . |

*Primary Examiner*—Ernest G. Cusick
*Attorney, Agent, or Firm*—Stevens, Davis, Miller & Mosher

[57] ABSTRACT

A foldable bag for transporting dry granular powders has a flexible and collapsible skin top, sides and a base with the base a base incorporating a fluidizing port. To transport material the bag is supported to the frame or structure of a container and filled with any dry granular powder. The filling is performed through an orifice in the top portion of the bag. At a destination the contents of the bag are fluidized by providing aeration of the contents through the base of the bag. Once fluidized the contents of the bag are then emptied under gravity or vacuum through outlet ports in the base of the bag. The fluidizing is accomplished a series of channels in the base of the bag with holes for the release of air and with an aeration cloth generally covering these holes. The base of the bag incorporating the fluidizing can be detached from the rest of the bag enabling appropriate recovery or repair of parts of the bag. The bag is provided with ties or the like to support the bag to the frame or structure of a container when being used to transport dry granular powders. The bag can be used with a variety of standard containers. When empty the bag can be folded, including the base portion, for storage or return for re-loading while the container is free for other uses.

17 Claims, 5 Drawing Sheets

BAG FOR TRANSPORTING DRY GRANULAR POWDERS

BACKGROUND OF THE INVENTION

The present invention relates to a bag for the transport of dry granular powders in a convenient and efficient manner. The invention also relates to a collapsible bag that can be folded to a more compact form once the transport of the powder has been completed. One example of a dry granular powder to which the invention has application is fly ash.

Fly ash is used as a neutral ingredient in many building materials. In the prior art, it has been transported in rigid containers which require much manipulation at either end of the journey. It is generally gravity discharged from the container into a storage hopper. Vacuum pumping techniques have also been used to empty a container. The chief disadvantage of prior art devices is the wasted volume of the container once emptied and its weight for cartage and manipulation. Fluidized techniques have been used previously, for example, to discharge fine particulate matter from ships; however, these installations are bulky and as fixed installations not transportable in the sense required, of the present invention.

In particular the prior art of U.S. Pat. No. 4,182,386 by Alack describes a bag having a rigid base part and a flexible upper skin. The container is basically part of a closed system adapted for the fluidized unloading of powder substantially without the release of dust during filling and unloading. The container comprises a rigid base which limits the volume to which the container can be reduced if it is not carrying powder.

In PCT application No. PCT/FI82/00015 (WO82/03826) the transport of dry granular or floury material involves a truck having a flexible sack with a special discharge funnel. The funnel includes apparatus to aerate the region of discharge to ease emptying of the sack. The sack can be folded to allow the container to be used for other uses. However the full volume of the container cannot be used due to the volume occupied by the folded sack and the funnel.

In Australian patent No. 558,894 (12,418/83) in the name of Dale Patrick Elwell a container is modified to allow the transport of dry granular powders. The modifications include a skin, fluidizing pads in the base of the container and a special chute for unloading the powder in a fluidized state. The lining of the container is slit or has a slit which can be opened to allow the contents to be removed. The container in this patent is substantially modified to accommodate the transport of the dry powder.

Each of these prior art apparatus involve containers which are specifically modified for the transport of the dry powder. This limits their utility.

The present invention comprises a bag which can be used with standard transport containers with the containers merely supplying support for the bag. The bag when empty can be folded into a compact form for shipment allowing the container to be used normally.

SUMMARY OF THE INVENTION

In accordance with the present invention there is disclosed a bag for the transport of dry granular powdered materials including a generally flexible and collapsible skin for holding a volume of dry granular powdered materials, the skin having top, side and a base portions, fluidizing means in said base portion for providing aeration of the powdered material, input means connecting to said fluidizing means in said base portion for providing pressurized gas to aerate the powdered material, output means connecting to said base portion for withdrawing the powdered material from said bag, means for filling the bag, and means for supporting the bag during filling and during transport thereof when in a filled or partially filled state.

DESCRIPTION OF THE PREFERRED EMBODIMENTS

The bag and its function will now be described with respect to the transport of fly ash.

Figure 1:
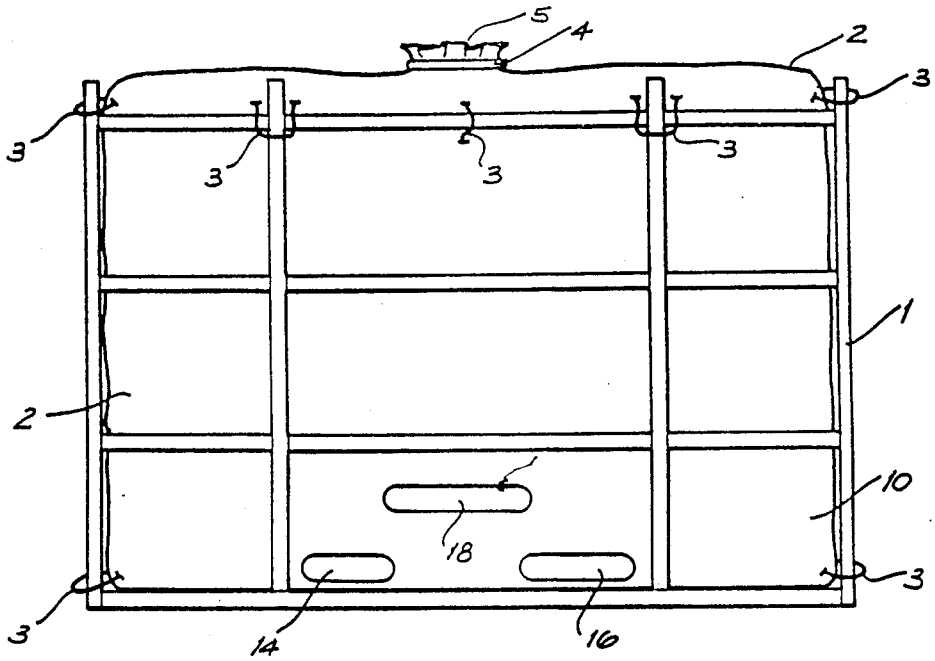
FIG. 1 shows a schematic drawing of the bag according to the invention in a condition suitable for transport.

FIG. 1 shows the bag 2 attached by suitable tie means such as loops 3 to the frame of a standard transport container 1. The container 1 is shown as a steel frame and wire open structure for ease of illustration only. Other types of container to hold the bag 2 are contemplated. A container of 2 m×2.4 m×6 m (6.6 ft×7.9 ft×19.7 ft) holds approximately 20 tons (20,000 kg or 44,000 lb) of fly ash in bag 2.

The bag 2 is made of a suitably strong and flexible material such as reinforced synthetic fibre or rubberised cloth. The exterior of the bag 2 is provided with tie means 3 to allow the bag 2 to be secured to the container 1. The tie means 3 may be spaced approximately every 0.6 meters (2 feet) around the perimeter of the bag and be made of a suitably elasticised material to allow resilient support of the weighted bag. The bag 2 has a filling or venting orifice 5 at a suitably central location in the top of the bag 2. The bag 2 can also be provided with a securing means 4 to hold a filtration cloth when the bag is being aerated during emptying.

The bag 2 has a base portion 10 the elements of which are best described with reference to FIGS. 2 or 3.

Figure 2:
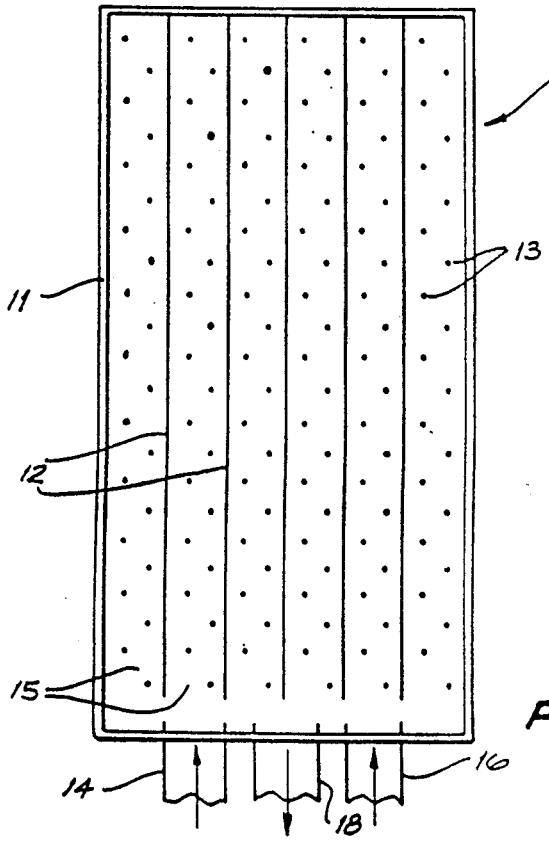
FIG. 2 shows a cross-sectional schematic through the base portion of the bag shown in FIG. 1.

In FIG. 2, this base portion 10 is provided with inlet ports 14 and 16 and outlet port 18, which are preferably provided at one end of the bag 2.

The inlet ports 14 and 16 take pressurized gas from an external source and distribute it along channels 15 formed in the base portion 10. The channels 15 are formed in the base portion 10 by welding or sewing (as shown as integer 7 in FIGS. 3 and 4) a sheet of material, e.g. rubberized cloth, along channel edges 12 to the outer skin or wall of bag 2. The surface towards the inside of bag 2 of these channels is provided with holes 13 distributed along their length. The number and size of these holes 13 are chosen to match the area provided by the inlet ports 14 and 16. To provide a uniform distribution of the pressurized gas into the volume of the bag 2 to fluidise the fly ash contents an aeration cloth 17 (as shown in FIG. 4) is sewn to the base to cover the channels 15.

An outlet port 18 is provided preferably at the same end as inlet ports 14 and 16. This outlet port 18 is connected to a negative pressure pumping device to evacuate the contents of the bag 2. The inlet ports 14 and 16 and outlet port 18 are provided at one end of the bag 2 so that a simple attachment of the appropriate air hoses thereto can be achieved. The outlet port 18 is a length of flexible hose which receives a nozzle of an evacuating pump and the two are clamped together to provide a secure mating fit with the edge of the nozzle flush with the wall 11 of the bag 2. The flexibility in the hose allows the nozzle to be moved about by an operator to ensure substantially full evacuation of the fly ash contained in the bag 2.

Figure 3:
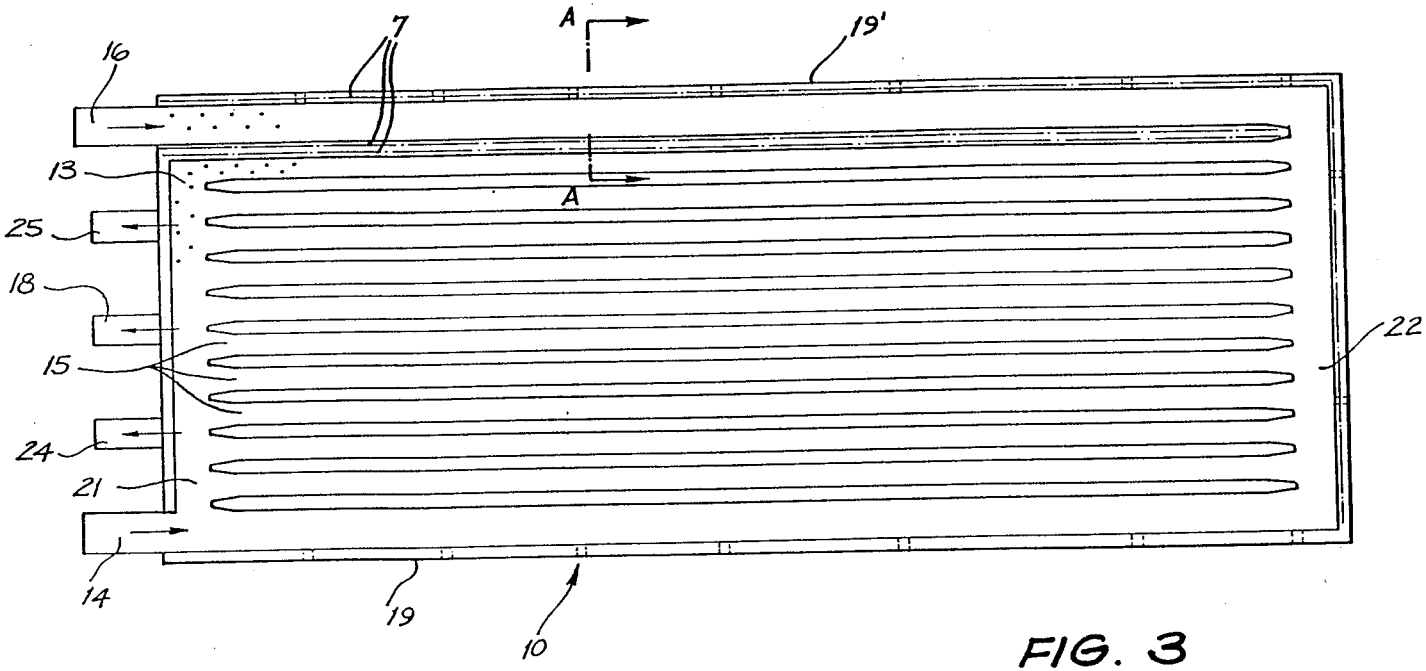
FIG. 3 shows another embodiment of the base portion of the bag according to the invention.

An alternative construction for the base portion 10 is shown with reference to FIG. 3. In this embodiment the base portion 10 is provided with inlet ports 14 and 16 towards the sides 19 and 19' of the bag. Channels 15 are formed in a serpentine pattern between ports 14 and 16 connected by manifolds 21 and 22 at the front and rear of the bag. Aeration outlets or holes 13 are provided as before. Three outlet ports 18, 24 and 25 (shown schematically in FIG. 3) are provided in place of the one port 18 to improve the evacuation of the bag. This is shown schematically in FIGS. 5 and 6. These outlet ports 18, 24 and 25 are located with two ports 24 and 25 adjacent the inlet ports 14 and 16 respectively as shown in FIG. 3, and one port 18 located centrally much as shown in FIGS. 1 and 2. This construction improves the removal of the particulate material especially along the sides 19 and 19' of the base 10 of the bag.

Figure 4:
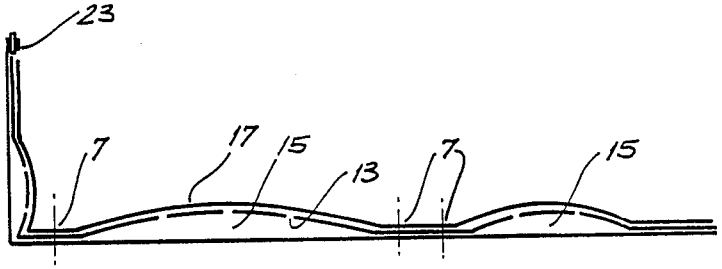
FIG. 4 is a cross-sectional view through line A—A of FIG. 3.

The base 10 may be fixed to the wall of the bag by a zipper 23 as shown in FIG. 4. The zipper 23 allows the base 10 of a damaged bag to be recovered and re-used.

The use of the bag 2 will now be described. The bag 2 is secured by tie means 3 to the frame or structure of a suitable container 1. The bag 2 could previously have been in a folded and collapsed state. The inlet ports 14, 16 and outlet ports 18, 24 and 25 are, or have been, closed off by suitable ties or other means to prevent loss of fly ash through these ports. The bag 2 is filled with fly ash through filling or venting orifice 5, the flexibility in the bag material allowing the bag to assume its full size equivalent to the volume defined by the container 1. As entrapped air makes the powder fluid the fly ash is allowed to settle. Depending on the container this settling step may be unnecessary. When a simple frame container 1 as in FIG. 1 is used 20–30 minutes settling time is allowed for the powder to resume a more solid consistency. The filling or venting orifice 5 is then closed off by suitable means. The container 1 is now transported to a destination, e.g. by road or rail.

Figure 6:
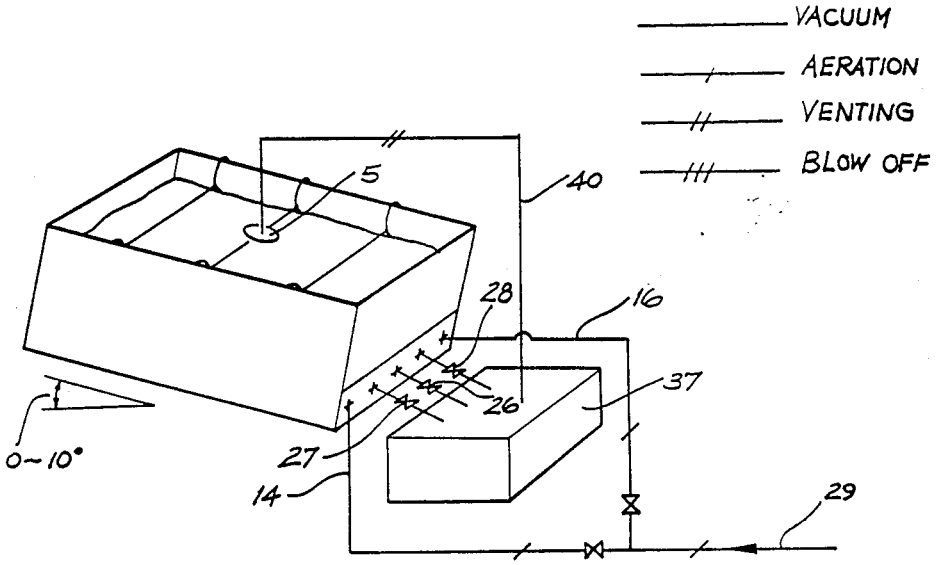
FIGS. 5 and 6 show schematically two methods of emptying the bag.
Figure 5:
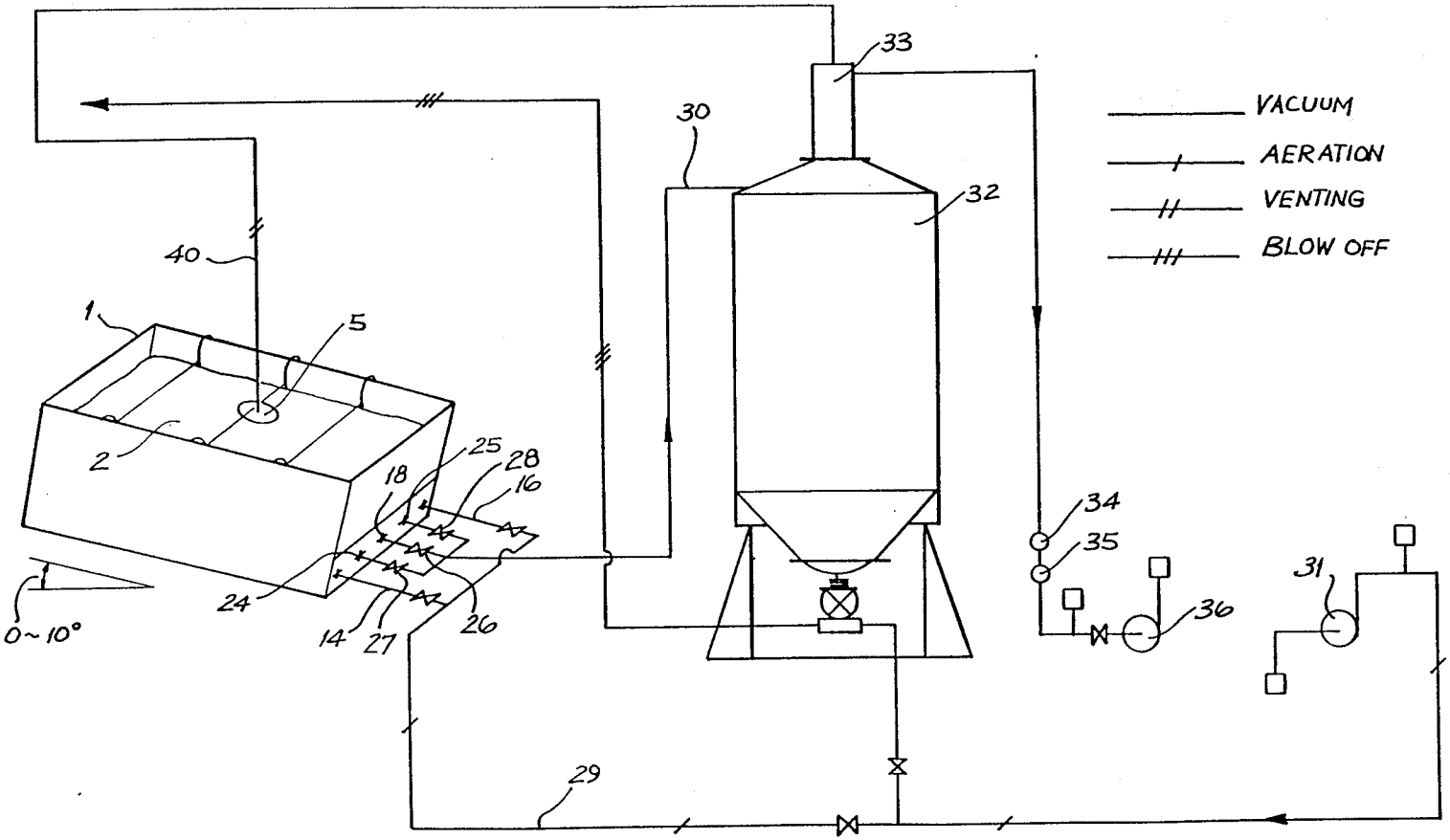
Figure 7:
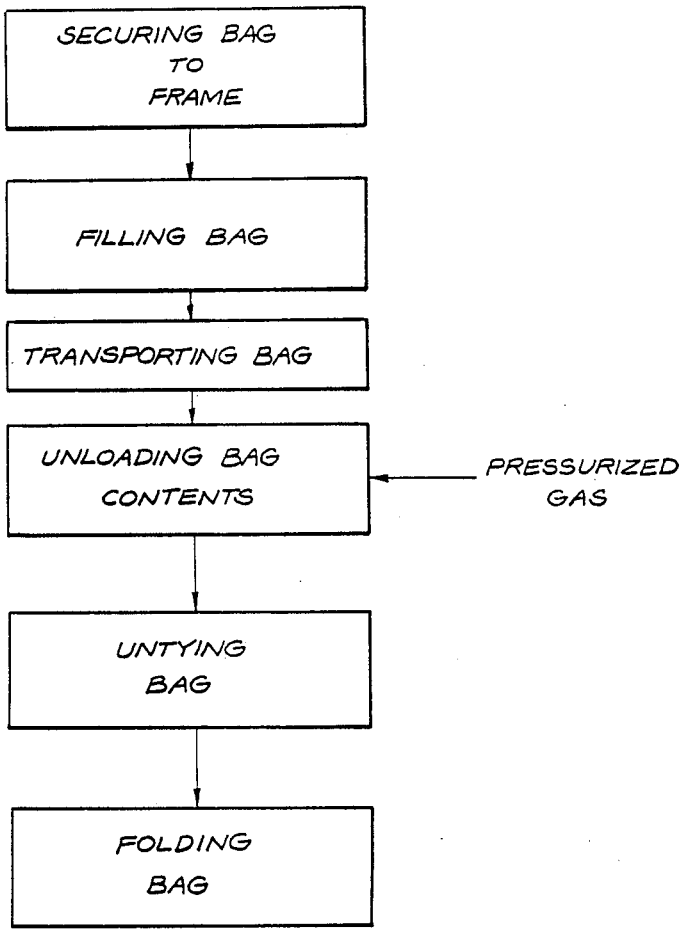
FIG. 7 shows schematically the steps of utilizing the bag according to the disclosed method.

At the destination the contents of the bag 2 held by container 1 are unloaded in a manner with reference to either FIG. 5 or FIG. 6. The container 1 is inclined at an angle of greater than 6°, preferably 10°, with respect to the horizontal. This inclination of the container is to overcome the friction of the contents of the fly ash once fluidized. That is, this angle is chosen to at least equate with the angle of repose of the fluidized fly ash.

As shown with reference to FIG. 5 the inlet ports 14 and 16 and outlet ports 18, 24 and 25 are connected to appropriate pressurized source hoses 29 and vacuum pump hoses 30 respectively. The pressurized source hoses 29 are connected to a blower 31 providing the pressurized source. The vacuum pump hose 30 is connected to receiving hopper 32. The hopper 32 is connected via primary filter 33, non-return valve 34, and secondary filter 35 to vacuum pump 36. The filling or venting orifice 5 is opened and connected to the main silo or the receiving hopper 32 in FIG. 5 (or hopper 37 in FIG. 6) via vent line 40. Alternatively, orifice 5 can be covered with a filtration cloth as shown by filter means 4 in FIG. 1 to contain the fly ash but allow pressurized gas to escape. The fly ash is now aerated from the pressurized source 31 and this is continued preferably for a period to allow complete fluidization of the particulate contents. The hoses connecting to outlet ports 18, 24 and 25 are provided with valves 26, 27 and 28 respectively. The outlet valve 26 or valves 26, 27 and 28 as the case may be is/are kept closed during this period which has been found for the size of container mentioned above at a working pressure of 20 kPa (2.9 $lb/in^2$) to be approximately 10–20 minutes.

With the orifice 5 left open pumping can now be initiated from outlet port 18 by opening valve 26. A negative pressure difference of 50 kPa (7.26 $lb/in^2$) has been found satisfactory to empty the 20 tons (44,000 lb) of the abovementioned container in 35 minutes. Either of the outermost pair of valves 27 and 28 controlling outlets 24 and 25 need only be opened towards the completion of the evacuation to aid collection of material along the sides 19 and 19'. To maintain pressure only one valve is opened at any given time. Further the nozzle connected to the outlet port 18 can be moved about. These steps combine to allow substantially the full volume of fly ash contents to be removed from the bag.

Although the contents of the bag are described as being pumped out under negative pressure, the fluidisation of the contents of the bag and the inclination of the container will suffice to allow the bag to empty. The powder under the aeration from line 29 from the pressurized source 31 acts as a fluid. This alternate procedure avoids the need of an evacuation pump 36 and is shown schematically in FIG. 6. The bag simply empties from outlets 18, 24 and 25 into receiving hopper 37 under gravity discharge once fluidization has been achieved and outlet valve 26 or valves 26, 27 and 28 have been opened as required.

The hoses can now be removed from their associated ports and these ports closed off. The tie means 3 can then be released from the container 1 and the bag 2 folded to a more compact shape. The container 1 can now be reused for carrying other goods while bag 2 occupying much less space can be sent back to the source for refilling.

While the foregoing describes embodiments of the invention the invention is not to be construed as limited thereto. Other variations in the invention are also contemplated. For example, the inlet and outlet ports need not be located at the same end of the bag 2. The outlet port 18 or ports 18, 24 and 25 could be at the opposite end of bag 2 to the inlet ports 14 and 16. The bag when being emptied is then inclined so that the fluidized material flows towards the outlet port or ports. Instead of a single filling/venting orifice 5 two separate holes can be provided for respectively filling the bag and venting the bag during emptying.

The bag can also be used for the transport of other types of powdered materials other than fly ash.

What is claimed is:

1. A container for the transport of dry granular powdered materials including, a generally flexible and collapsible bag having a skin for holding a volume of dry granular powdered material, said skin having top, side and base portions, a fluidizing means in said base portion for providing aeration of the powdered material, input means connecting to said fluidizing means in said base portion for providing pressurizing gas to aerate the powdered material, output means connecting to said base portion for withdrawing the powdered material from said bag, means for filling the bag, and means for supporting the bag during filling and during transport thereof when in a filled or a partially filled state, said skin including said base portion so that when empty said base portion is foldable to a compact form.

2. A container as claimed in claim 1 wherein said fluidizing means includes a plurality of channels formed in said base portion, each of said channels having a plurality of holes for admitting air to the interior of said bag.

3. A container as claimed in claim 2 wherein each of said channels are open at one end and closed at the other end, said open end of each of said channels connecting to a manifold which in turn is connected to said input means.

4. A container as claimed in claim 3 wherein said fluidizing means further include an aeration cloth covering said plurality of channels.

5. A container as claimed in claim 4 wherein said input and output means include valve means for regulating flow therethrough.

6. A container as claimed in claim 5 wherein said output means comprise a single outlet port.

7. A container as claimed in claim 6 wherein said base portion of said skin is detachably connected to the side portions of said skin.

8. A container in claim 7 wherein said means for filling include an orifice in the top of said bag and a venting hole associated therewith.

9. A container as claimed in claim 2 wherein each of said channels are open at either end, said input means including a first and a second inlet port, each of said channels being connected in parallel between said first and said second ports.

10. A container as claimed in claim 9 wherein said fluidizing means further include an aeration cloth covering said plurality of channels.

11. A container as claimed in claim 10 wherein said input and output means include valve means for regulating flow therethrough.

12. A container as claimed in claim 11 wherein said output means include three outlet ports in said base portion.

13. A container as claimed in claim 11 wherein said base portion of said skin is detachably connected to the side portion of said skin.

14. A container as claimed in claim 13 wherein said means for filling include an orifice in the top portion of said bag and a venting hole associated therewith.

15. A method for transporting dry granular powdered material in a container, said container including, a generally flexible and collapsible bag having a skin for holding a volume of dry granular powdered material, said skin having top, side and base portions, a fluidizing means in said base portion for providing aeration of the powdered material, input means connecting to said fluidizing means in said base portion for providing pressurized gas to aerate the powered material, output means connecting to said base portion for withdrawing the powdered material from said bag, means for filling the bag, and means for supporting the bag during filling and during transport thereof when in a filled or a partially filled state, said method including the steps of:

securing said bag by said supporting means to a frame or container, filling the bag so supported with dry granular powdered material, transporting the bag to a destination, unloading the contents of the bag at the destination including the steps of:

applying pressurized gas to said input means for a time sufficient to fluidize the contents of the bag through said fluidizing means, selectively operating said output means to discharge said fluidizing contents of said bag, untieing said bag from said supporting frame or container once empty, and folding said bag to a compact form for return for refilling.

16. A method as claimed in claim 15 further including the step of, inclining said bag at said destination, to an angle equal to or greater than the angle of repose of the fluidizing dry granular powdered material.

17. A method as claimed in claim 16 wherein said angle of repose is between 6° and 10°.

* * * * *